US005586855A

United States Patent [19]

Eshleman

[11] Patent Number: 5,586,855

[45] Date of Patent: Dec. 24, 1996

[54] APPARATUS AND METHOD FOR INFEEDING BATCHED MATERIALS

[76] Inventor: Roger D. Eshleman, 506 Clayton Ave., Waynesboro, Pa. 17268

[21] Appl. No.: 157,359

[22] Filed: Nov. 23, 1993

[51] Int. Cl.[6] ..... F23G 5/00

[52] U.S. Cl. ..... 414/160; 414/152; 414/167; 414/199; 110/346

[58] Field of Search ..... 414/150, 152, 414/156–7, 160, 167, 171–3, 180, 184, 187, 198–9, 216, 586, 609; 110/204–5, 289, 346; 198/463.4, 468.8, 468.11

[56] References Cited

U.S. PATENT DOCUMENTS

| | | | |
|---|---|---|---|
| 3,815,523 | 6/1974 | Gilbeault | 110/204 |
| 3,855,950 | 12/1974 | Hughes, Jr. et al. | 414/187 X |
| 4,144,961 | 3/1979 | Kasahara et al. | 198/468.8 X |
| 4,234,283 | 11/1980 | Twyman et al. | 414/171 |
| 4,492,503 | 1/1985 | Thomas et al. | 414/156 X |
| 4,507,039 | 3/1985 | Sawa et al. | 414/152 |
| 4,832,154 | 5/1989 | Thoor | 198/463.4 X |
| 4,934,283 | 6/1990 | Kydd | 110/246 |
| 5,167,772 | 12/1992 | Parker, Sr. | 414/173 X |
| 5,195,883 | 3/1993 | Hanna et al. | 110/204 X |
| 5,271,341 | 12/1993 | Wagner | 110/346 |
| 5,338,144 | 8/1994 | Eshleman | 414/152 |

*Primary Examiner*—James W. Keenan

[57] ABSTRACT

An apparatus for infeeding batched material to an inlet opening of a material processing apparatus includes a lift mechanism disposed alongside the material processing apparatus and being operable to lift the batched material at least to the elevation of the inlet opening of the material processing apparatus, a delivery conveyor disposed alongside the material processing apparatus and adjacent to the lift mechanism and being operable to deliver the batched material to the lift mechanism, a transfer enclosure spaced from the lift mechanism and disposed above the inlet opening of the material processing apparatus, the transfer enclosure having a side entrance for receiving batched material from the lift mechanism and a bottom exit for subsequent discharge of the batched material into the material processing apparatus through the inlet opening thereof, a tilt assembly disposed between the lift mechanism and the transfer enclosure and being operable to either block or complete a path for transfer of the batched material from the lift mechanism to the transfer enclosure, a transfer mechanism spaced above the tilt assembly and extending between the lift mechanism and transfer enclosure and being operable to transfer the batched material from the lift mechanism, over the tilt assembly, and into the transfer enclosure, and a closure mechanism disposed contiguous with the bottom exit of the transfer enclosure and being operable to transfer the batched material from the transfer enclosure into the material processing apparatus via its inlet opening.

44 Claims, 9 Drawing Sheets

APPARATUS AND METHOD FOR INFEEDING BATCHED MATERIALS

CROSS REFERENCE TO RELATED APPLICATIONS

Reference is hereby made to the following U.S. applications dealing with subject matter related to the present invention:

1. "Apparatus And Method For Controlled Processing Of Materials" by Roger D. Eshleman and Paul S. Stevers, assigned U.S. Ser. No. 07/987,928 and filed Dec. 9, 1992, now U.S. Pat. No. 5,353,719, issued Oct. 11, 1994.
2. "Apparatus And Method For Transferring Batched Materials" by Roger D. Eshleman, assigned U.S. Ser. No. 08/026,719 and filed Mar. 5, 1993, now U.S. Pat. No. 5,338,144, issued Aug. 16, 1994.
3. "Sloped-Bottom Pyrolysis Chamber And Solid Residue Collection System In A Material Processing Apparatus" by Roger D. Eshleman, assigned U.S. Ser. No. 08/123,455 and filed Sep. 17, 1993.
4. "Material Transport Pusher Mechanism In A Material Processing Apparatus" by Roger D. Eshleman, assigned U.S. Ser. No. 08/123,747 and filed Sep. 17, 1993, now U.S. Pat. No. 5,361,709, issued Nov. 8, 1994.

BACKGROUND OF THE INVENTION

1. Field of the Invention

The present invention generally relates to material processing and, more particularly, is concerned with an apparatus and method for infeeding batched materials, such as medical and other waste matter, into a material processing apparatus.

2. Description of the Prior Art

The problem of disposal of waste matter involves a material processing challenge that is becoming increasingly acute. The primary material processing methods of waste disposal have been burning in incinerators and burial in landfills. These two material processing methods have severe disadvantages. Burning of waste liberates particulate matter and fumes which contribute to pollution of the air. Burial of wastes contributes to the contamination of ground water. A third material processing method is recycling of waste. Although increasing amounts of waste are being recycled, which alleviates the problems of the two primary material processing methods, presently available recycling methods do not provide a complete solution to the waste disposal problem.

The problem of disposal of biomedical waste materials is even more acute. The term "biomedical waste materials" is used herein in a generic sense to encompass all waste generated by medical hospitals, laboratories and clinics which may contain hazardous, toxic or infectious matter whose disposal is governed by more stringent regulations than those covering other waste. It was reported in *The Wall Street Journal* in 1989 that about 13,000 tons a day of biomedical waste, as much as 20% of it infectious, is generated by around 6,800 U.S. hospitals.

Hospitals and other generators of biomedical waste materials have employed three main material processing methods of waste handling and disposal: (1) on-site incineration with only the residue transferred to landfills; (2) on-site steam autoclaving and followed by later transfer of the waste to landfills; and (3) transfer of the waste by licensed hazardous waste haulers to off-site incinerators and landfills. Of these three main material processing methods, theoretically at least, on-site disposal is the preferred one.

However, many hospital incinerators, being predominantly located in urban areas, emit pollutants at a relatively high rate which adversely affect large populations of people. In the emissions of hospital incinerators, the Environmental Protection Agency (EPA) has identified harmful substances, including metals such as arsenic, cadmium and lead; dioxins and furans; organic compounds like ethylene, acid gases and carbon monoxide; and soot, viruses, and pathogens. Emissions of these incinerators may pose a public health threat as large as that from landfills.

Nonetheless, on-site disposal of biomedical waste materials still remains the most promising solution. One recent on-site waste disposal unit which addresses this problem is disclosed in U.S. Pat. No. 4,934,283 to Kydd. This unit employs a lower pyrolyzing chamber and an upper oxidizing chamber separated by a movable plate. The waste material is deposited in the lower chamber where it is pyrolyzed in the absence of air and gives off a combustible vapor that, in turn, is oxidized in the upper chamber. While this unit represents a step in the right direction, it does not appear to approach an optimum solution to the problem of biomedical waste material disposal.

SUMMARY OF THE INVENTION

The present invention provides a method and apparatus for infeeding batched materials, such as medical and other waste matter, for use in conjunction with a material processing apparatus designed to satisfy the aforementioned needs. While the batched materials infeeding apparatus of the present invention can be used in different applications, it will be described herein in conjunction with the material processing apparatuses disclosed in the first, third and fourth copending patent applications cross-referenced above which apparatuses are particularly useful in waste disposal and particularly effective in disposing biomedical waste material on-site where the waste material is produced.

Accordingly, the present invention is directed to an apparatus for infeeding batched material to an inlet opening of a material processing apparatus. The infeeding apparatus of the present invention comprises: (a) a lift mechanism disposed alongside the material processing apparatus and being operable to lift the batched material at least to the elevation of the inlet opening of the material processing apparatus; (b) a delivery conveyor disposed alongside the material processing apparatus and adjacent to the lift mechanism and being operable to deliver the batched material to the lift mechanism; and (c) a transfer enclosure spaced from the lift mechanism and disposed above the inlet opening of the material processing apparatus, the transfer enclosure having an entrance for receiving the batched material from the lift mechanism and an exit for subsequent discharge of the batched material into the material processing apparatus through the inlet opening thereof. The infeeding apparatus also comprises: (d) a tilt assembly disposed between the lift mechanism and the transfer enclosure and being operable to either block or complete a path for transfer of the batched material from the lift mechanism to the transfer enclosure; and (e) a transfer mechanism spaced above the tilt assembly and extending between the lift mechanism and transfer enclosure and being operable to transfer the batched material from the lift mechanism, over the tilt assembly, and into the transfer enclosure. The infeeding apparatus further comprises: (f) a closure mechanism disposed contiguous with the bottom exit of the transfer enclosure and being operable to control transfer of the batched material from the transfer enclosure through the inlet opening and into the material processing apparatus.

More particularly, the lift mechanism includes a transfer deck for supporting the batched material and a drive assembly supporting the deck and being operable to move the deck between a lowered loading position and a raised unloading position. At the lowered loading position the deck is located at an elevation lower than that of the inlet opening of the material processing apparatus, whereas at the raised unloading position the deck is located at an elevation higher than that of the lowered loading position and also preferably slightly higher than that of the inlet opening of the material processing apparatus. Also, the deck of the lift mechanism is mounted by the drive assembly thereof to undergo movement in a transverse direction relative to the direction of the movement of the deck between the raised and lower positions thereof. Such capability of the deck to move transversely permits it to relocate the batched material supported thereon so that it will be in a desired alignment with the entrance of the transfer enclosure once the deck has reached the raised unloading position of the lift mechanism.

The transfer enclosure includes a hood and a door pivotally mounted to the hood. The hood defines an interior chamber having the entrance on a side thereof open from the exterior into the interior chamber of the hood and the exit spaced from the entrance on the bottom thereof open from the interior chamber into the material processing apparatus through the inlet opening thereof. The door is pivotally mounted to the hood for undergoing swinging movement relative to the hood between a lowered position closing the side entrance and a raised position opening the side entrance of the hood.

The tilt assembly includes a platform extending between the raised unloading position of the lift mechanism and the side entrance of the hood. The platform is mounted to undergo pivotal movement about a transverse pivot axis between an inclined position and a generally level position. In the inclined position, the platform obstructs the path for travel of the batched material from the lift mechanism to the hood, whereas in the generally level position the platform completes the path for travel of the batched material from the lift mechanism to the hood. The platform is biased toward the level position.

The pivotal movement of the door on the hood of the transfer enclosure between its lowered and raised positions controls the pivotal movement of the platform between its inclined and level positions. At its lowered position the door will overlie and engage a discharge end of the platform and maintain the platform at the inclined position, obstructing the path of the batched material from the lift mechanism to the transfer enclosure, whereas at its raised position the door permits the platform to move to the level position. Thus, when the side entrance of the hood is opened by the door being in the raised position, the platform is in its level position, unblocking and completing the path for the batched material to move from the lift mechanism to the transfer enclosure.

The transfer mechanism includes an elongated guide member and an elongated drive member spaced laterally from one another and disposed between the raised unloading position of the lift mechanism and the side entrance of the hood. The transfer mechanism also includes a pusher member extending transversely between and coupled at opposite ends to the elongated guide member and elongated drive member. The elongated drive member is drivingly coupled to the pusher member so as to cause reciprocal movement of the pusher member between the raised unloading position of the lift mechanism and the side entrance of the hood to thereby transfer the batched material across the tilt assembly from the lift mechanism and into the hood through the opened side entrance thereof.

The closure mechanism includes a guide track, a closure gate and an actuator. The guide track has one end contiguous with the bottom exit of the hood of the transfer enclosure. The remainder of the guide track extends away from the hood. The closure gate is mounted to the guide track for undergoing slidable movement therealong. The actuator is operable to reciprocally move the closure gate along the guide track relative to the hood between extended and retracted positions in which the closure gate respectively closes and opens the bottom exit of the hood and the inlet opening of the material processing apparatus.

The present invention also is directed to a method of infeeding batched material to an inlet opening of a material processing apparatus. The infeeding method of the present invention comprises the steps of: (a) loading a batched material onto a deck disposed at a lowered loading position; (b) lifting the loaded deck from the lowered loading position below the elevation of an inlet opening of a material processing apparatus to a raised unloading position above the elevation of the inlet opening; and (c) transferring the batched material from the deck through an entrance of a hood spaced therefrom and disposed above and enclosing the inlet opening for subsequent discharge of the batched material into the material processing apparatus through the inlet opening thereof. The infeeding method also comprises the steps of: (d) moving the batched material on the deck in a transverse relation to the direction of movement of the deck from the lowered loading position to the raised unloading position in order to locate the batched material in a desired alignment with the entrance to the hood enclosure once the deck has reached the raised unloading position; and (e) pushing the batched material from the deck at the raised unloading position across a platform to the entrance to the hood. The infeeding method further comprises: (f) after receiving the batched material in the hood, closing the entrance to the hood; and (g) after closing the entrance to the hood, opening the exit from the hood to discharge the batched material from the hood through the exit thereof and through the inlet opening and into the material processing apparatus.

The present invention further is directed to a method for infeeding batched material to an inlet opening of a material processing apparatus without releasing gases from the material processing apparatus to the external atmosphere. The infeeding method comprises the steps of: (a) providing a hood in a sealed relationship over an inlet opening of the material processing apparatus, the hood defining an interior chamber having an entrance open from the external atmosphere to the interior chamber of the hood and an exit spaced from the entrance and open from the interior chamber of the hood to the interior of the material processing apparatus through the inlet opening thereof; (b) opening the entrance of the hood; (c) transferring batched material into the interior chamber of the hood through the open entrance thereof; (d) closing the entrance of the hood; (e) opening the exit of the hood; (f) discharging the batched material from the interior chamber of the hood through the open exit thereof; (g) closing the exit of the hood; and (g) simultaneously delivering fresh air from the external atmosphere into the interior chamber of the hood and exhausting gases from the interior chamber to the material processing apparatus in order to remove any gases received in the hood from the material processing apparatus via the inlet opening thereof during when the exit of the hood was open and thereby substantially eliminate the release of such gases to the external atmosphere upon subsequent opening of the entrance to the hood and transferring of batched material therein.

These and other features and advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DETAILED DESCRIPTION OF THE INVENTION

Figure 1:
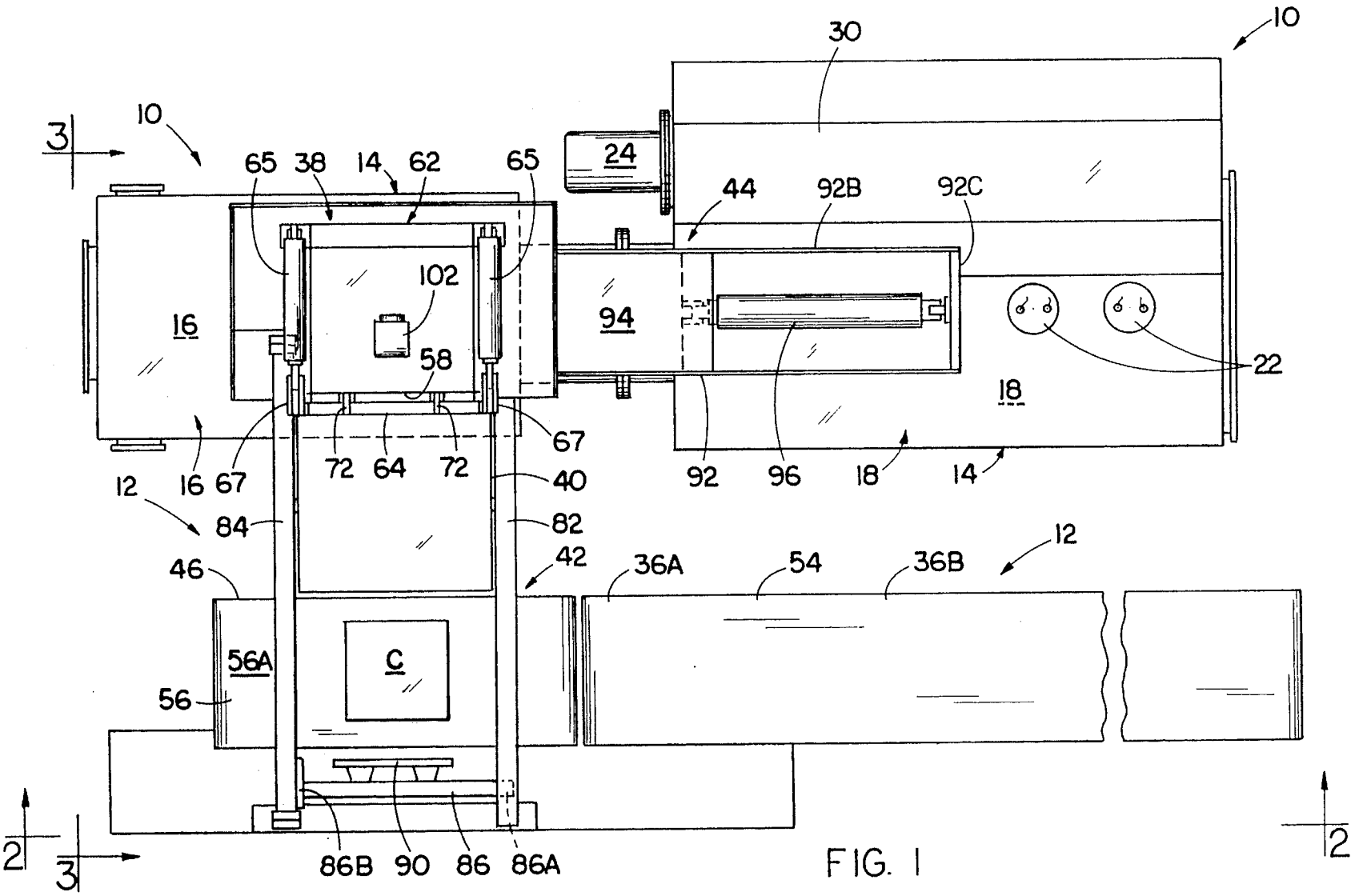
FIG. 1 is a top plan view of an apparatus of the present invention for infeeding batched materials being shown in conjunction with an apparatus for controlled processing of materials, such as medical and other waste matter.
Figure 2:
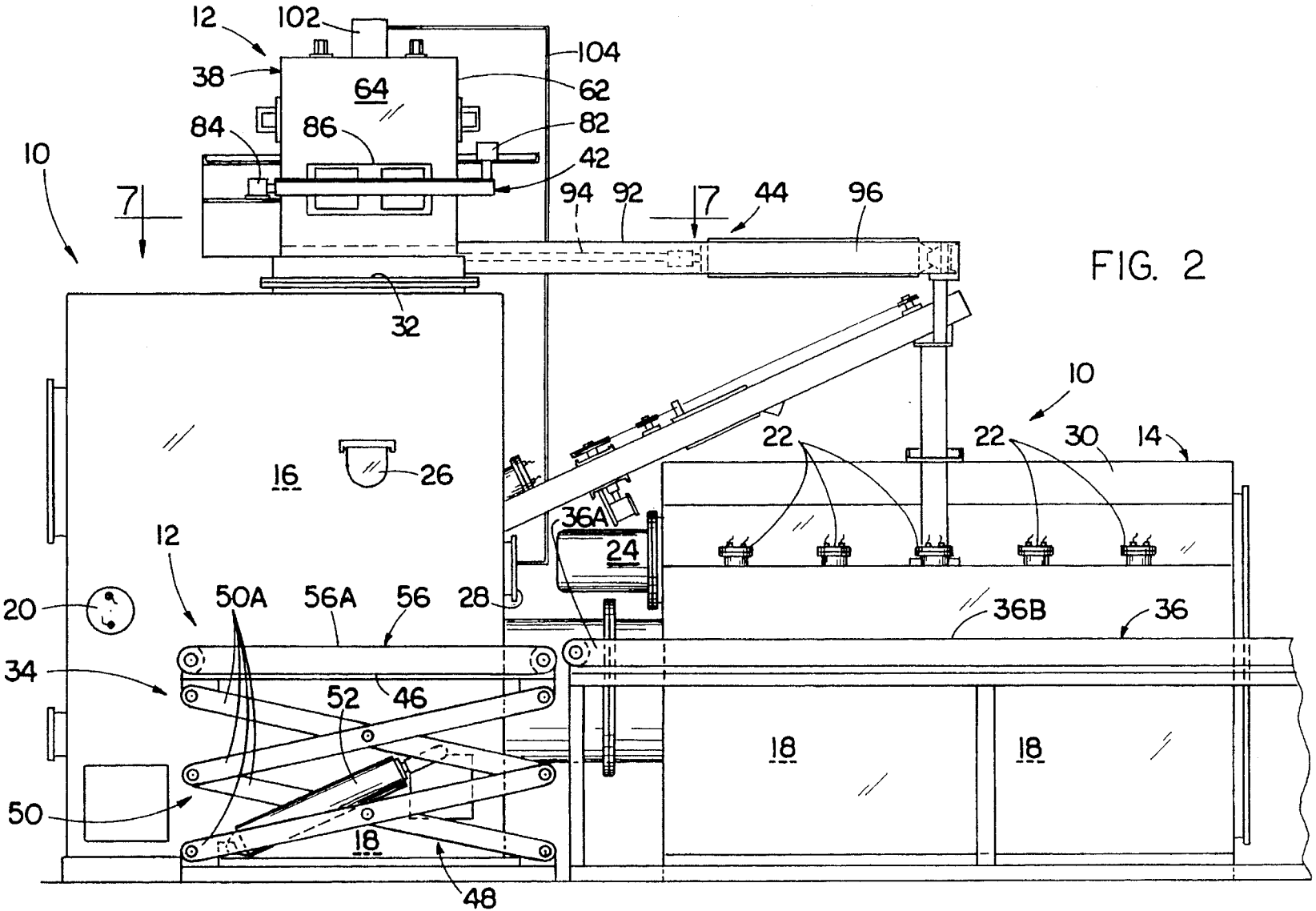
FIG. 2 is a front elevational view of the batched materials infeeding apparatus as seen along line 2—2 of FIG. 1.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated an apparatus, generally designated 10, for controlled processing materials, and in particular for controlled disposal of biomedical waste materials. Also in FIG. 1, there is shown an apparatus, generally designated 12, for infeeding batched materials, such as medical and other waste matter, into the material processing apparatus 10. The batched materials infeeding apparatus 12 constitutes the subject matter of the present invention. The features of the material processing apparatus 10 comprise the subject matters of the first, third and fourth copending patent applications cross-referenced above. A detailed understanding of the material processing apparatus 10 is not necessary to gain a complete and thorough understanding of the batched materials infeeding apparatus 12, which will be described in detailed hereinafter. Accordingly, only a brief description of the material processing apparatus 10 will be given hereinafter.

Material Processing Apparatus

Referring to FIGS. 1 to 4, the material processing apparatus 10 basically includes a coolant jacketed vessel 14 defining a first pyrolysis chamber 16 and a second oxidation chamber 18. The material processing apparatus 10 also includes one or more first heater units 20 mounted in the vessel 14 and being operable to electrically generate heat for pyrolyzing materials in the first pyrolysis chamber 16, and one or more second heater units 22 mounted in the vessel 14 and being operable to electrically generate heat for oxidizing materials in the second oxidation chamber 18.

The material processing apparatus 10 further includes an air flow generating means, preferably an induction fan 24, connected in flow communication with the first and second chambers 16, 18, and first and second airflow safety or inlet valves 26, 28 connected to the jacketed vessel 14. The material processing apparatus 10 also includes an air intake proportioning valve (not shown) connected in flow communication with the first and second air inlet valves 26, 28. The induction fan 24, proportioning valve, and first and second inlet valves 26, 28 function to produce separate primary and secondary variable flows of air respectively into and through the first and second chambers 16, 18. The respective amounts of air in the primary and secondary flows through the first and second chambers 16, 18 are proportioned by the operation of the proportioning valve to separately adjust ratio of the amounts of air flow routed to the first and second air inlet valves 26, 28. The respective amounts of air in the primary and secondary flows are correspondingly varied by varying the speed of operation of the induction fan 24.

Still further at least three temperature sensors (not shown), such as conventional thermocouples, are mounted on the vessel 14 for sensing the temperatures in the first and second chambers 16, 18 and in the coolant circulating about a channel defined by the jacketed vessel 14 about the first and second chambers 16, 18. Additionally, a gas sensor (not shown) is mounted on a discharge outlet (not shown) of the vessel 14 for sensing the concentration of a predetermined gas, for example oxygen, in the discharge gases. A computer-based central control system (not shown) is incorporated in the material processing apparatus 10 for controlling and directing the overall operation of the apparatus 10. Further, a heat exchanger 30 is connected in flow communication between the second chamber 18 and the discharge outlet. The heat exchanger 30 functions to remove heat from and thereby cool the coolant flowing through the channel defined by jacketed vessel 14. The heat removed by the heat exchanger 30 can be employed in other applications in the facility housing the material processing apparatus 10.

During each given cycle of operation of the material processing apparatus 10, the first pyrolysis chamber 16 in which materials will be pyrolyzed receives the materials in batched form through an inlet opening 32 formed in the top of the vessel 14 above the first chamber 16. The batched material, through prolysis, or burning in a starved oxygen atmosphere, is converted to a gas that exits the first chamber 16 and passes into the second chamber 18. The second chamber 18 oxidizes the pyrolyzed materials and discharges the oxidized materials through the discharge outlet. The exhaust gas is virtually free of any pollution and the original material has been almost completely oxidized so that only a small amount of fine minute powder particles are collected in a particle separator (not shown) .

Batched Materials Infeeding Apparatus

Referring again to FIGS. 1 to 4, the batched material infeeding apparatus 12 of the present invention is illustrated disposed alongside and above the material processing apparatus 10 and in flow communication with the upper inlet opening 32 of the material processing apparatus 10. In its basic components, the batched material infeeding apparatus 12 includes a lift mechanism 34, a delivery conveyor 36, a transfer enclosure 38, a tilt assembly 40, a transfer mechanism 42 and a closure mechanism 44.

The lift mechanism 34 of the infeeding apparatus 12 is disposed alongside the material processing apparatus 10 and is operable to lift, one at a time, a container C of batched material from below to a short distance above the elevation of the inlet opening 32 of the material processing apparatus 10. The delivery conveyor 36 of the infeeding apparatus 12 is also disposed alongside the material processing apparatus 10 and adjacent to the lift mechanism 34 and is operable to deliver the container C of batched material to the lift mechanism 34.

Figure 3:
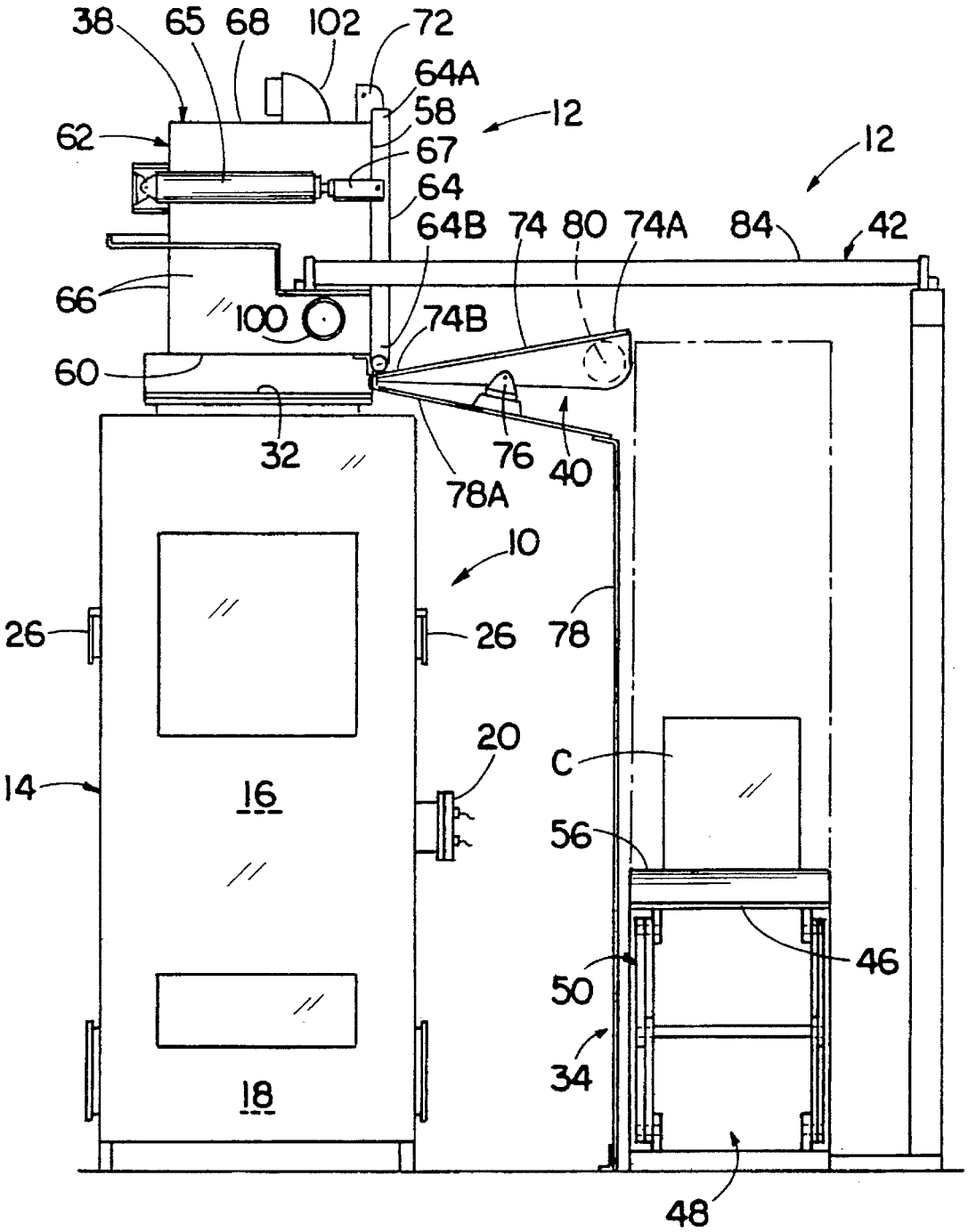
FIG. 3 is a side elevational view of the batched materials infeeding apparatus as seen along line 3—3 of FIG. 1.
Figure 4:
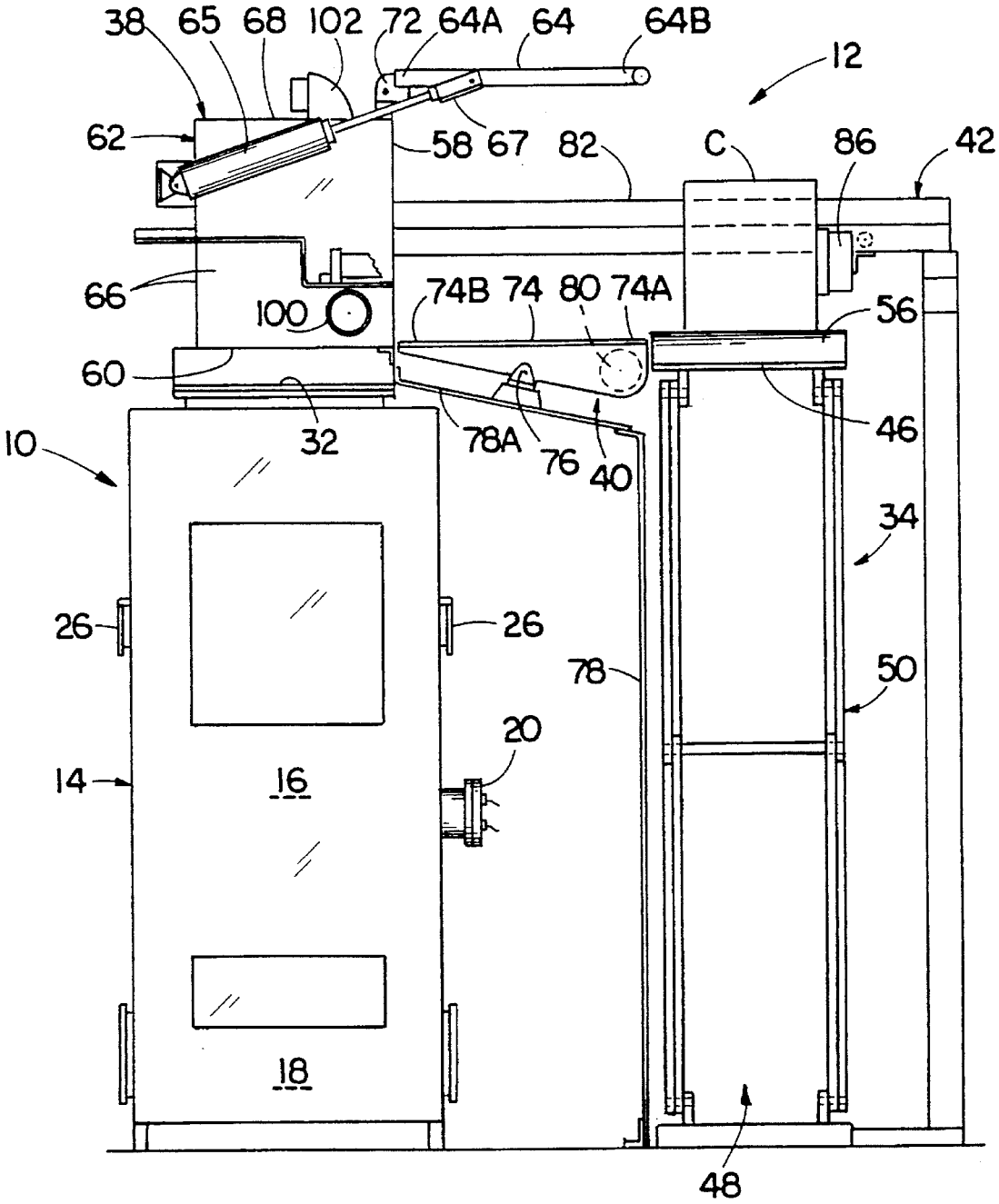
FIG. 4 is a view similar to that of FIG. 3 but showing the batched materials infeeding apparatus at a step in its operation following the step depicted in FIG. 3.

The lift mechanism 34 includes a transfer deck 46 and a drive assembly 48 supporting the deck 46 and being operable to move the deck 46 vertically between a lowered loading position, as shown in FIG. 3 and a raised unloading position, as shown in FIG. 4. The drive assembly 48 includes a vertically elongatable and contractable scissor arrangement 50 and an actuator 52, such as one or more hydraulic or air cylinders, extending between and pivotally interconnecting a pair of the plurality of pivotally connected legs 50A forming the scissor arrangement 50. Extension of the actuator 52 causes elongation of the scissor arrangement 50 to the extended position shown in FIG. 4 which raises the deck 46 to the raised unloading position. Conversely, retraction of the actuator 52 causes contraction of the scissor assembly 50 to the contracted position shown in FIG. 3 which lowers the deck 46 to the lowered loading position. At the lowered loading position the deck 46 is located at an elevation substantially lower than that of the inlet opening 32 of the material processing apparatus 10 so that the delivery conveyor 36 can readily load the container C of batched material thereon. At the raised unloading position the deck 46 is located at an elevation slightly higher than that of the inlet opening 32 of the material processing apparatus 10 so that the transfer mechanism 42 to be described hereinafter can readily unload the container C of batched material therefrom and move the container C to the transfer enclosure 38.

The delivery conveyor 36 has a discharge end portion 36A disposed adjacent, and in a transfer relationship, to the lowered loading position of the deck 46 of the lift mechanism 34 for depositing the container C thereon. The main portion 36B of the delivery conveyor 36 extends away from the lift mechanism 34 and provides space for loading the containers of batched material on the delivery conveyor 36. Then, each time the deck 46 of the lift mechanism 34 is disposed at the lowered loading position, an endless belt 54 rotationally mounted on the delivery conveyor 36 is operated in a conventional manner to advance and deposit one of the containers C of the batched material onto the deck 46.

The deck 46 of the lift mechanism 34 is also mounted by the drive assembly 48 thereof for undergoing movement in a transverse or horizontal direction relative to the vertical direction of movement of the deck 46 between the raised and lower positions thereof. Such capability of the deck 46, which is provided by movable conveyor in the form of an endless belt 56 rotationally mounted thereon whose upper span 56A can move transversely, permits the deck 46 to relocate the container C of batched material supported thereon so that it will be in a desired alignment with the transfer enclosure 38 so as to readily move through a side entrance 58 thereof once the deck 46 has reached the raised unloading position of the lift mechanism 34.

Referring to FIGS. 1–11, the transfer enclosure 38 of the infeeding apparatus 12 is spaced from the lift mechanism 34 and has the side entrance 58 for receiving, one at a time, the container C of batched material from the lift mechanism 34 and a bottom exit 60 overlying the inlet opening 32 of the material processing apparatus 10 for subsequent discharge of the container C of batched material into the material processing apparatus 10 through the inlet opening 32 thereof. More particularly, the transfer enclosure 38 has a hood 62, a door 64 pivotally mounted to the hood 62, and a pair of actuators 65 for opening and closing the door 64 relative to the side entrance 58. The hood 62 has a generally rectangular shape being formed by interconnected vertical side walls 66 and a horizontal top wall 68 connected in a sealed relationship to the top of the vessel 14 of the material processing apparatus 10 so as to overlie the top inlet opening 32 thereof. The hood 62 so constructed defines an interior chamber 70 having the side entrance 58 thereto defined through the one of the side walls 66 facing toward the lift mechanism 34 which side entrance 58 opens from the exterior into the interior chamber 70 of the hood. Also, the hood 62 so constructed defines the bottom exit 60 of the interior chamber 70 spaced from the entrance 58 and on the bottom of the hood 62 and which opens from the interior chamber 70 into the material processing apparatus 10 through the inlet opening 32 thereof. The door 64 is pivotally mounted to the hood 62 at pivots 72 located above the side entrance 58 to undergo swinging movement relative to the hood 62 and side entrance 58 between a lowered position closing the side entrance 58, as shown in FIG. 3, and a raised position opening the side entrance 58, as shown in FIG. 4, correspondingly upon retraction and extension of the actuators 65 pivotally connected to and extending between the front and rear sides 66 of the hood 62 and brackets 67 fixed on the opposite sides of the door 62.

Referring to FIGS. 1, 3, 4 and 14–16, the tilt assembly 40 of the infeeding apparatus 12 is disposed between the lift mechanism 34 and the transfer enclosure 38 and is operable to either block or complete a path for transfer of the container C of batched material from the lift mechanism 34 to the transfer enclosure 38. Specifically, the tilt assembly 40 includes a flat platform 74 extending between the raised unloading position of the lift mechanism 34 and the side entrance of the hood. The platform 74 is pivotally mounted at pivot 76 to an upper section 78A of an elongated heat shield 78 being vertically disposed alongside the lift mechanism 34. The platform 74 is mounted to undergo pivotal movement between an inclined position (relative to a horizontal plane), as shown in FIG. 3, and a generally level position, as shown in FIG. 4, about a transverse pivot axis defined by the pivot 76 disposed between spaced opposite receiving and discharging ends 74A, 74B of the platform 74. In the inclined position of the platform 74 shown in FIG. 3, it can be readily observed that the platform 74 will obstruct a path for travel of the container C of batched material from the lift mechanism 34 over the platform 74 to the side entrance 58 to the hood 62. On the other hand, in the generally level position of the platform 74 shown in FIG. 4, it can be readily observed that the platform 74 completes and provides a clear and unobstructed path for travel of the container C of batched material from the lift mechanism 34 to the hood 62.

As mentioned above, the door 64 is pivotally mounted at an upper end 64A by pivots 72 to the hood 62 at locations above the side entrance 58 thereto. As can be understood with reference to FIGS. 3, 4 and 14–16, the pivotal movement of the door 64 between its lowered and raised positions by operation of the actuators 65 controls the pivotal movement of the platform 74 between its inclined and level positions. More particularly, at a lower end 64A the door 64 will overlie and engage the discharge end 74B of the platform 74 as the door 64 approaches and reaches its lowered position shown in FIG. 3. Such engagement of the door 64 with the platform 74 pivotally moves the platform 74 to and maintains the platform 74 at the inclined position, obstructing the path of the container C of batched material from the deck 46 to the hood 62, as long as the door 64 remains at its lowered position closing the side entrance 58 to the hood 62.

The tilt assembly 40 also has a biasing means in the form of a counterweight 80 mounted below the receiving end 74A of the platform 74 and spaced from the pivot axis 76 thereof. The counterweight 80 biases the platform 74 to pivotally move from the inclined position of FIG. 3 to the level position of FIG. 4 in response to release of engagement from the lower end 64B of door 64 upon pivotal movement of the door 64 from the lowered position of FIG. 3 to the raised position thereof of FIG. 4. Thus, when the side entrance 58 to the hood 62 is opened by the door 64, the platform 74 is always in its level position unblocking and completing the path for the transfer of the container C of batched material from the deck 46 of the lift mechanism 34 over the platform 74 to the hood 62 of the transfer enclosure 38.

Referring to FIGS. 1–4, 12 and 13, the transfer mechanism 42 of the infeeding apparatus 12 is located in a spaced relationship above the tilt assembly 40 and extends between the lift mechanism 34 and the transfer enclosure 38. The transfer mechanism 42 is operable to transfer the container C of batched material from the deck 46 of the lift mechanism 34, over the platform 74 of the tilt assembly 40, and into the hood 62 of the transfer enclosure 38. The transfer mechanism 42 includes an elongated guide member 82 and an elongated drive member 84 spaced laterally from one another and extending between the raised unloading position of the lift mechanism 34 and the side entrance 58 to the hood 62. The transfer mechanism 42 also includes a pusher member 86 extending transversely between and coupled at respective opposite ends 86A, 86B to the elongated guide member 82 and the elongated drive member 84. More particularly, referring to FIGS. 12 and 13, the elongated guide member 82 has a track 82A receiving a pair of rollers 88 rotatably mounted at the one end 86A of the pusher member 86. The elongated drive member 84 can be a rodless cylinder or a rotatable worm screw 84A having a nut 84B threaded thereon which is coupled to the other end 86B of the pusher member 86 whereby rotation of the worm screw 84A causes linear movement of the nut 84B between the opposite ends of the worm screw 84A and of the pusher member 86 along a forward stroke toward the hood 62 and a reverse stroke toward the lift mechanism. The pusher member 86 has an arm 90 mounted thereto and projecting forwardly therefrom sufficiently to cause the container C of batched material to be pushed through the side entrance 58 of the hood 62 and into the interior chamber 70 when the pusher member 86 reaches the end of its forward stroke. Thus, the elongated drive member 84 is drivingly coupled to the pusher member 86 so as to cause reciprocal movement of the pusher member 86 between the raised unloading position of the lift mechanism 34 and the side entrance 58 of the hood 62 to thereby transfer the container C of batched material from the lift mechanism 34 across the tilt assembly 40 and into the hood 62 through the opened side entrance 58 thereof.

Figure 6:
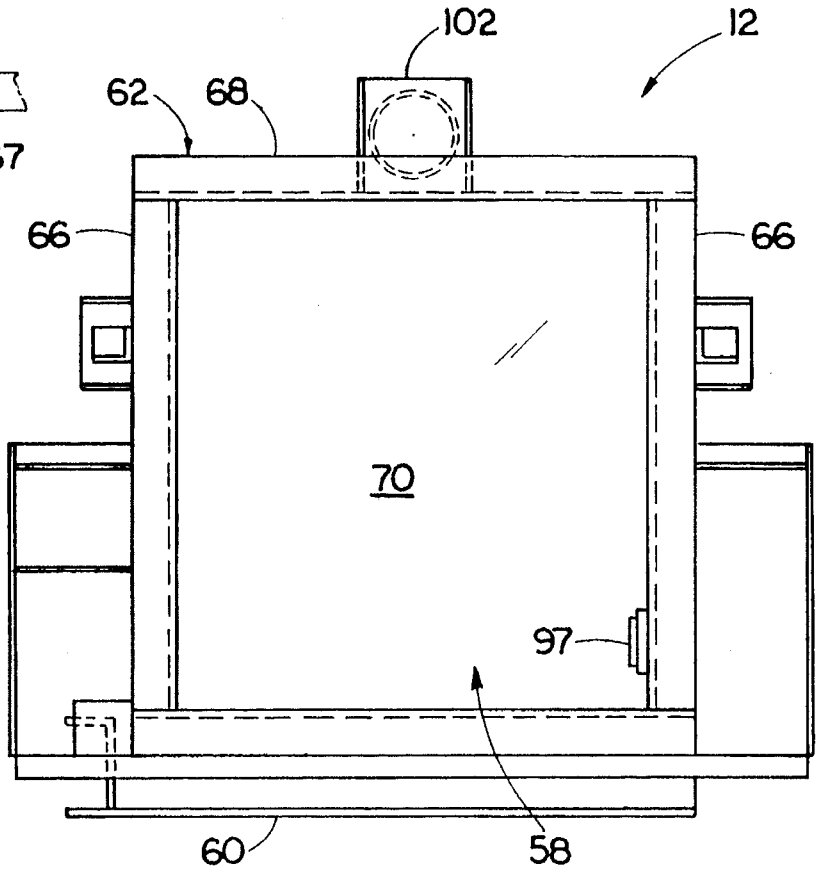
FIG. 6 is a front elevational view of the hood as seen along line 6—6 of FIG. 5.
Figure 5:
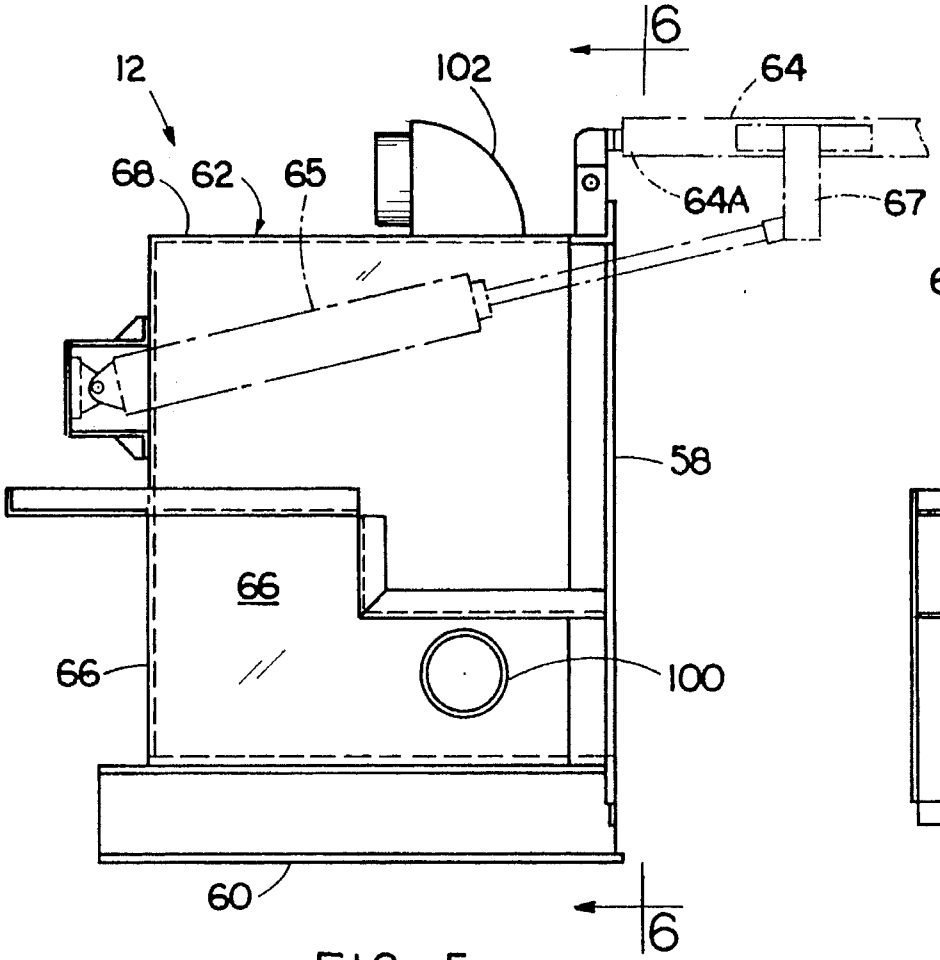
FIG. 5 is an enlarged side elevational view of a transfer enclosure of the infeeding apparatus as also seen in FIG. 4, with a door of a hood of the transfer enclosure being shown disposed in a raised position opening a side entrance of the hood.
Figure 7:
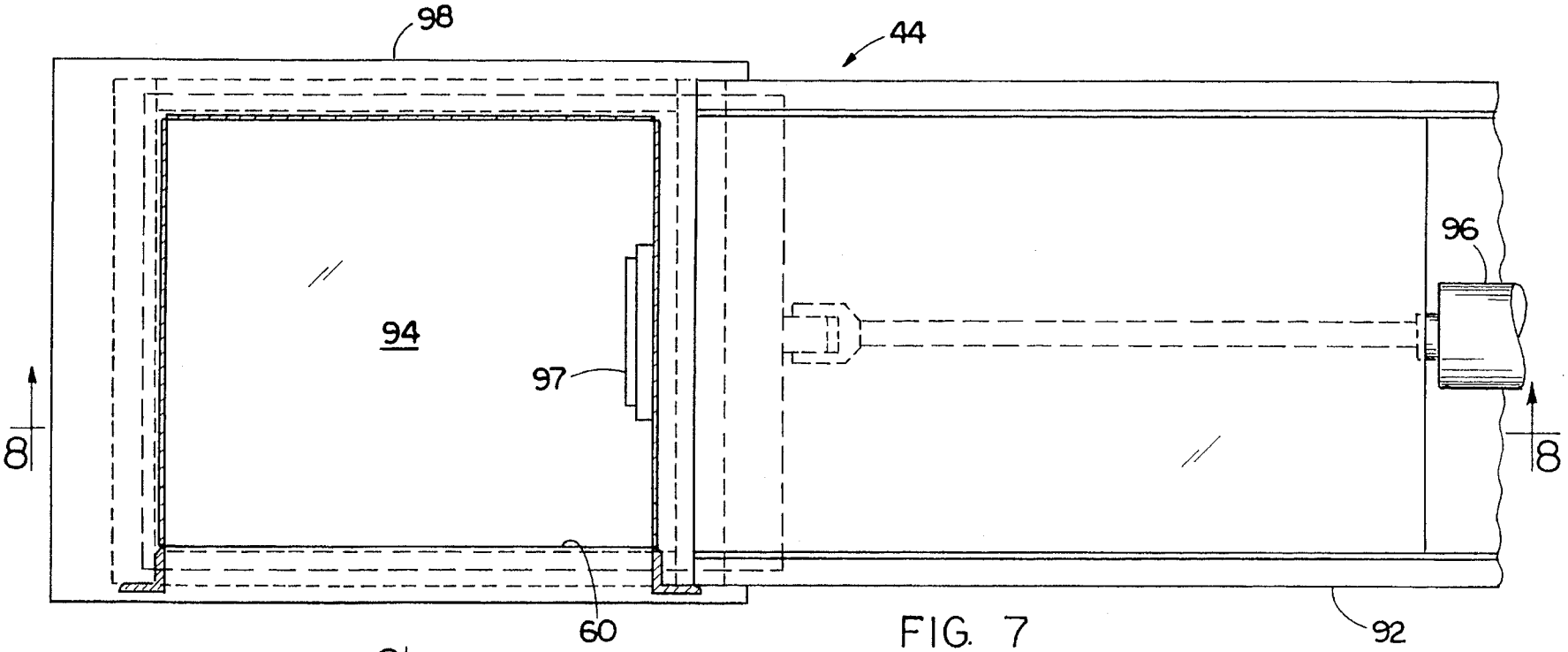
FIG. 7 is an enlarged top plan view of a guide track and a closure gate of a closure mechanism of the infeeding apparatus as seen along line 7—7 of FIGS. 2 and 8, showing the closure gate in an extended position closing a bottom exit of the hood.
Figure 8:
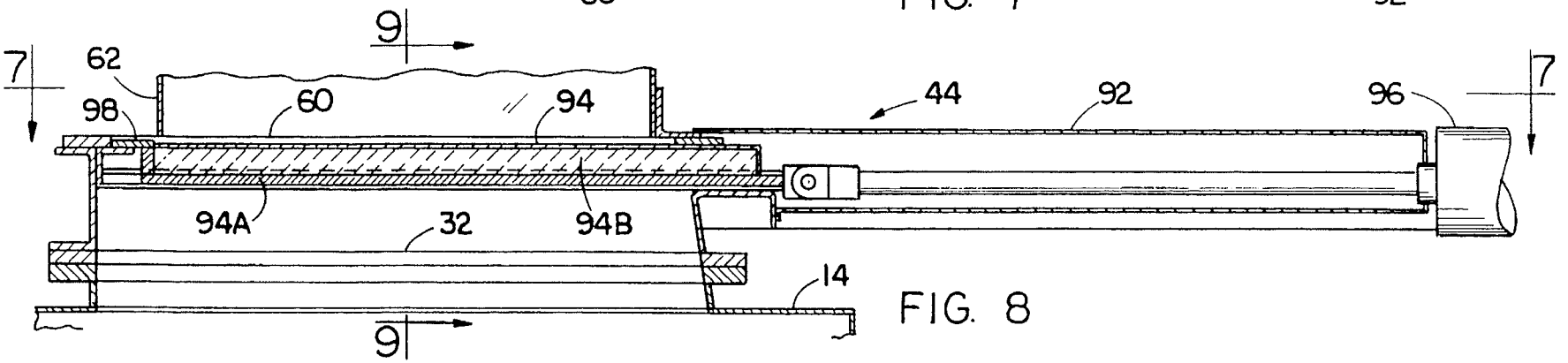
FIG. 8 is a longitudinal sectional view taken along line 8—8 of FIG. 7.
Figure 10:
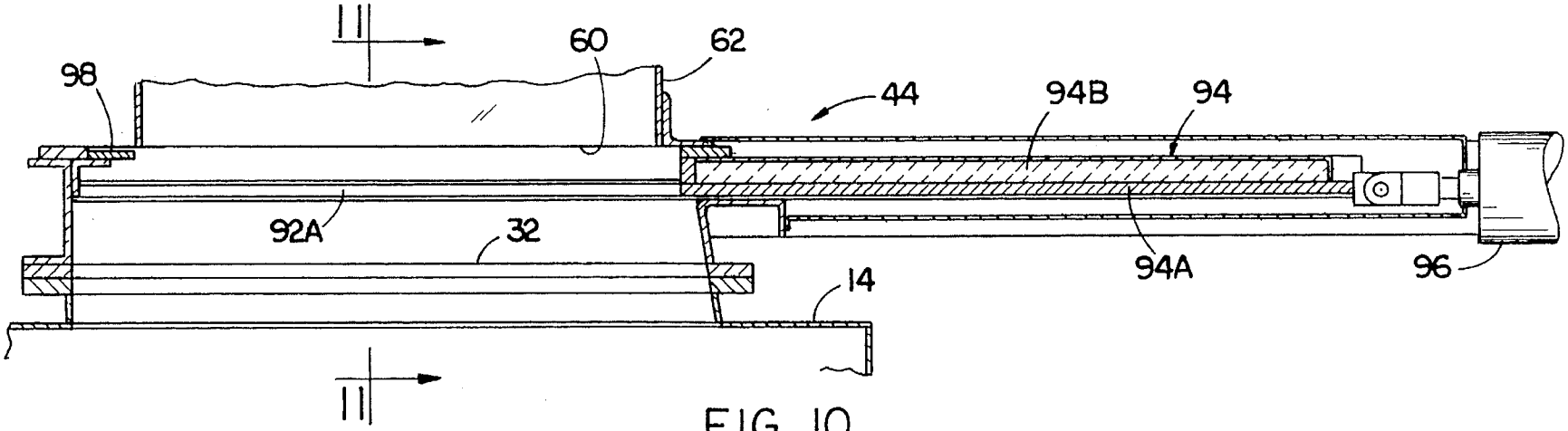
FIG. 10 is a view similar to that of FIG. 8, but showing the closure gate in a retracted position opening the bottom exit of the hood.
Figure 11:
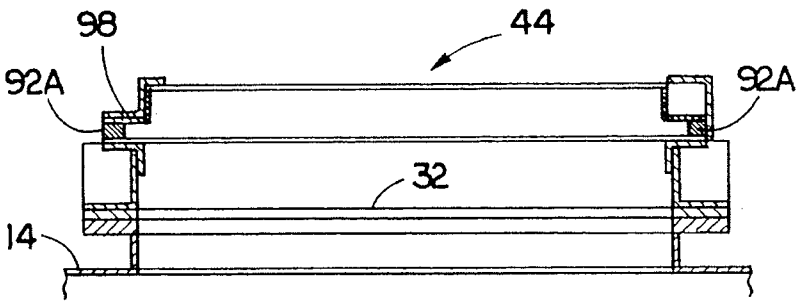
FIG. 11 is a transverse sectional view taken along line 11—11 of FIG. 10.
Figure 9:
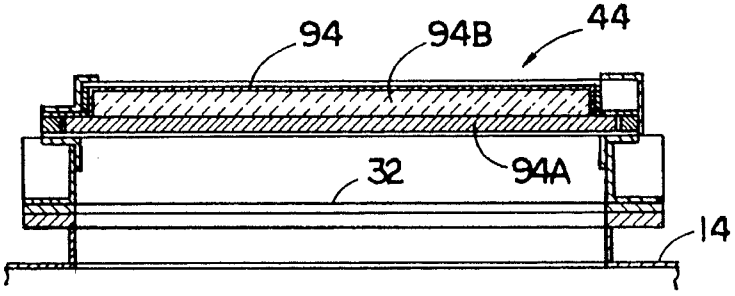
FIG. 9 is a transverse sectional view taken along line 9—9 of FIG. 8.
Figure 12:
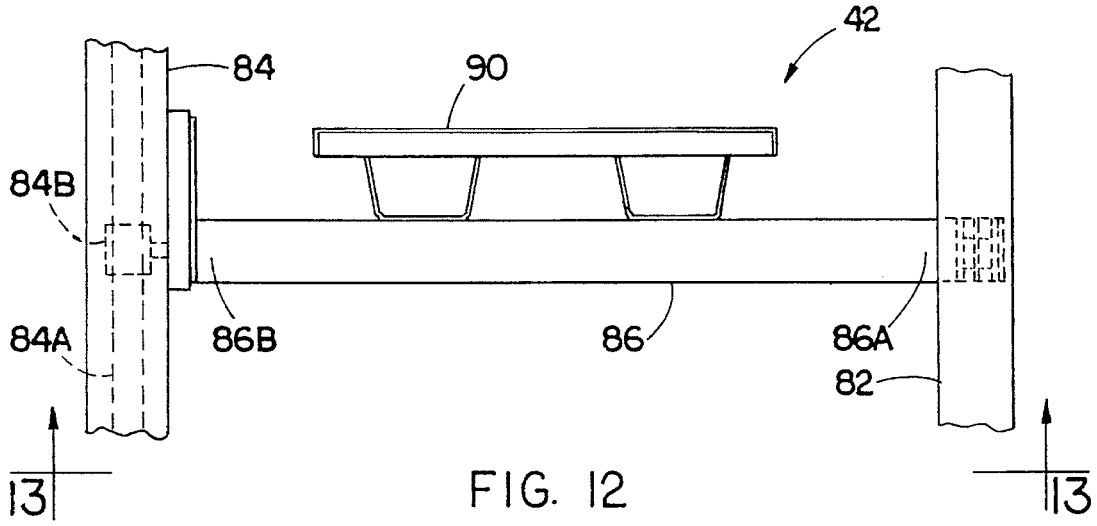
FIG. 12 is an enlarged top plan view of a pusher mechanism of the infeeding apparatus of FIG. 1 and as seen along line 12—12 of FIG. 13.
Figure 13:
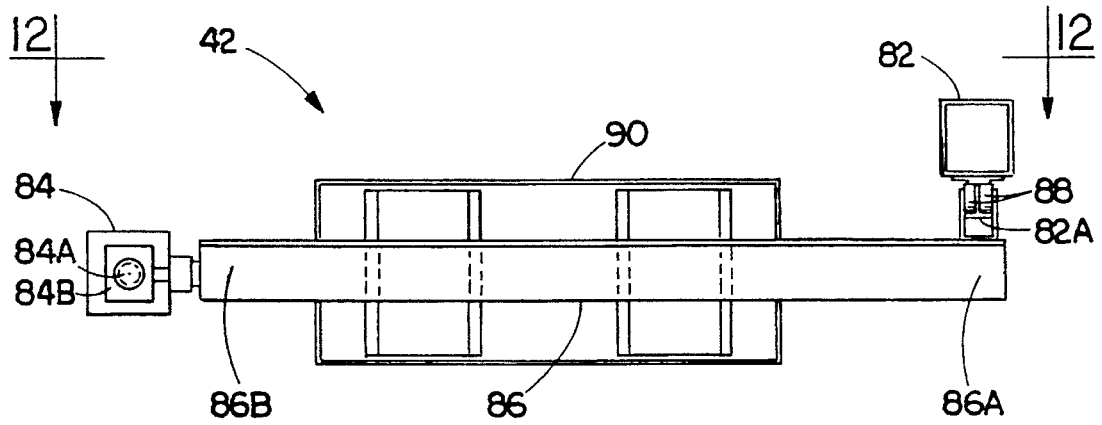
FIG. 13 is a front elevational view of the pusher mechanism as seen along line 13—13 of FIG. 12.
Figure 14:
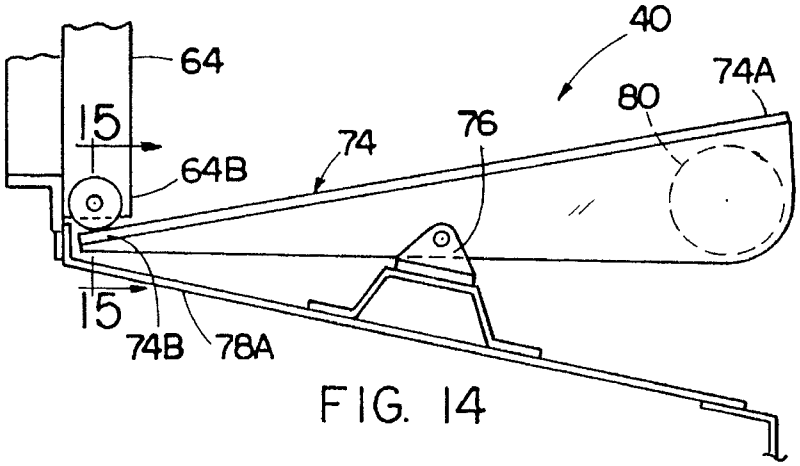
FIG. 14 is an enlarged side elevational view of a tilt assembly of the infeeding apparatus showing a pivotal platform of the tilt assembly in an inclined position, as also shown in FIG. 3.
Figure 15:
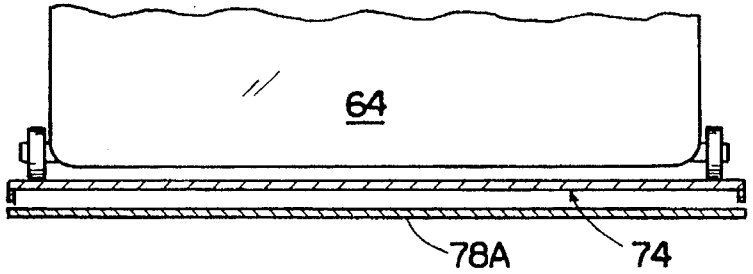
FIG. 15 is a fragmentary front elevational view of the door of the hood as seen along line 15—15 of FIG. 14.
Figure 16:
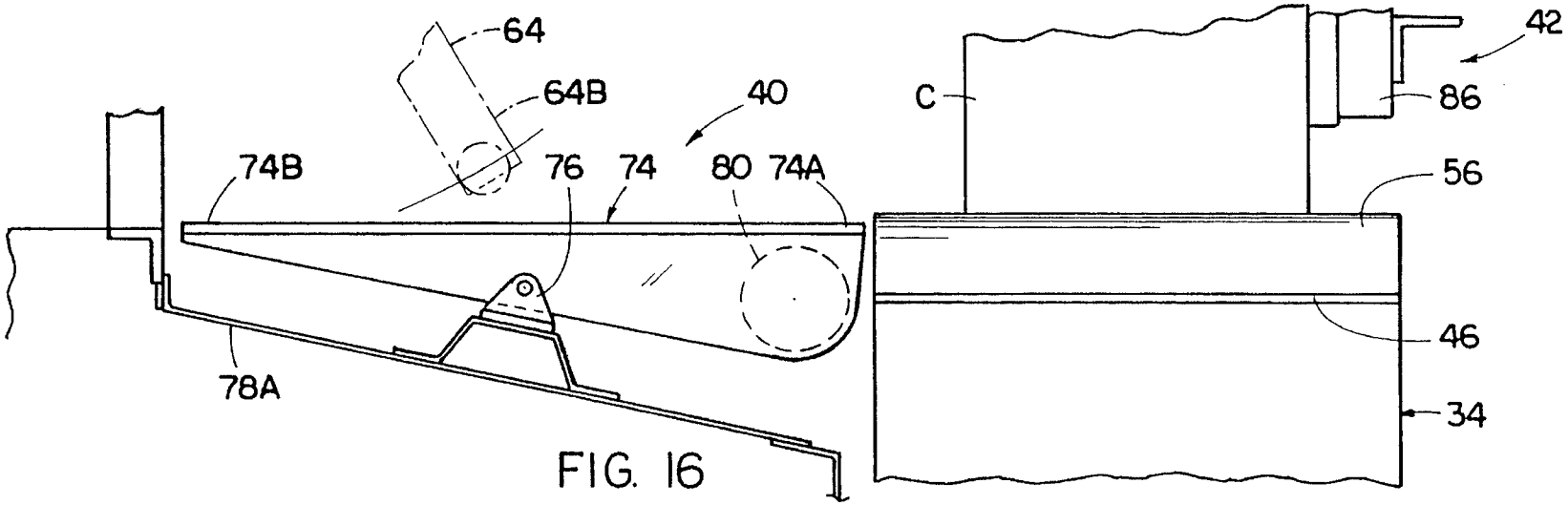
FIG. 16 is a view similar to that of FIG. 14, but showing the platform of the tilt assembly in a level position, as also shown in FIG. 4.

Referring to FIGS. 1, 2 and 7–11, the closure mechanism 44 of the infeeding apparatus 12 is disposed contiguous with the bottom exit 60 of the hood 62 of the transfer enclosure 38 and is operable to control the transfer of the container C of batched material from the hood 62 through the inlet opening 32 and into the material processing apparatus 10. The closure mechanism 44 includes an elongated guide track 92, a closure gate 94 and an actuator 96. The guide track 92 is constructed as a rectangular framework which is contiguous at one end portion 92A with the bottom exit 60 of the hood 62 of the transfer enclosure 38. The main portion 92B of the guide track 92 extends away from the hood 62. The closure gate 94 is constructed of a lower flat rigid plate 94A and an upper ceramic panel 94B sandwiched together. The opposite side edge portions of the lower panel 94A fit within and are slidably movable along opposite facing channels defined along opposite sides of the guide track 92. In such manner, the closure gate 94 is mounted to the guide track 92 for undergoing slidable movement therealong. The actuator 96, such as a hydraulic or air cylinder, is disposed between and coupled at opposite ends to an end 94A of the closure gate 94 and an opposite end 92C of the guide track 92. The actuator 96 is operable to reciprocally move the closure gate 94 along the guide track 92 relative to the hood 62 between extended and retracted positions, as shown respectively in FIGS. 8 and 10, in which the closure gate 94 respectively closes and opens the bottom exit 60 of the hood 62 and the inlet opening 32 of the material processing apparatus 10. Also, in order to facilitate and ensure positive and accurate dropping of the container of batched material through the bottom exit 60 of the hood 62 and top inlet opening 32 of the material processing apparatus 10 so that the opportunity for hangup of the container is substantially eliminated, a spacer structure 97 shown in FIGS. 6 and 7 is attached to the rear one of the side walls 66 of the hood 62 adjacent to and spaced above the guide track 92 and closure gate 94 and spaced above the bottom exit 60 of the hood 62. The spacer structure 97 is adapted to be engaged by the container of batched material present in the hood 62 and resting upon the closed closure gate 94 when the closure gate 94 begins to be retracted from the hood 62. The spacer structure 97 is positioned on the one end wall 66 so as to prevent the degree of tilting of the container of batched material that would produce misalignment of the container with the inlet opening 32 of the material processing apparatus 10. The spacer structure 97 prevents much tilting of the container until the closure gate 94 has substantially reached the retracted position fully opening the bottom exit 60 of the hood 62.

Finally, it is essential that the infeeding of the container C of batched material into material processing apparatus 10 through the top inlet opening 32 thereof be carried out without releasing gases from the material processing apparatus 10 to the external atmosphere. An annular frame 98 is also provided about the perimeter of the bottom exit 60 which contacts the closure gate 94 when in the closed position so as to form a seal therebetween which prevents passage of gases from the material processing apparatus 10 into the hood 62 when the bottom exit 60 is closed by the closure gate 94. However, when the closure gate 94 is retracted gases can pass from the material processing apparatus 10 upwardly through the top inlet opening 32 thereof and through the open bottom exit 60 of the hood 62 and into the interior chamber 70 thereof. These gases must be prevented from reaching the exterior atmosphere through the side entrance 58 of the hood 62 when the door 64 is opened to transfer a container C of batched material into the hood 62. A pair of spaced inlet and exhaust ports 100, 102 are provided for this purpose. The exhaust port 102 is connected by a conduit 104 in flow communication with one of the second airflow valves 28 on the vessel 12 of the material processing apparatus 10. At the end of one cycle of the infeeding apparatus 12 and before the start of a another cycle when both the door 64 and closure gate 94 are in their respective positions closing the side entrance 58 and bottom exit 60, then via operation of the induction fan 24 of the material processing apparatus 10, simultaneously as combustion gases are exhausted (drawn) from the interior chamber 70 through the exhaust port 102 and conduit 104 into the material processing apparatus 10, fresh air is delivered (drawn) from the external atmosphere into the interior chamber 70 of the hood 62 through the inlet port 100 to replace the exhausted combustion gases. In such manner, the combustion gases received into the hood 62 from the material processing apparatus 10 via the inlet opening 32 thereof during when the bottom exit 60 of the hood 62 was open are thereby substantially avoided from release to the external atmosphere upon subsequent opening of the side entrance 58 of the hood 62 to the external atmosphere for transferring of another container of batched material therein.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. An apparatus for infeeding batched material to an inlet opening of a material processing apparatus, said batched material infeeding apparatus comprising:

(a) a lift mechanism disposed alongside a material processing apparatus and being operable to lift a batched material at least to the elevation of an inlet opening of the material processing apparatus;

(b) a delivery conveyor disposed alongside the material processing apparatus and adjacent to said lift mechanism and being operable to deliver the batched material to said lift mechanism; and (c) a transfer enclosure spaced from said lift mechanism and disposed above the inlet opening of the material processing apparatus, said transfer enclosure having an entrance for receiving batched material from said lift mechanism and an exit for subsequent discharge of the batched material from said transfer enclosure into the material processing apparatus through the inlet opening thereof;

(d) said lift mechanism including (i) a transfer deck for supporting the batched material, and (ii) a drive assembly supporting said deck and being operable to have said deck between a lowered loading position and a raised unloading position, (iii) said transfer deck including movable means operable to undergo movement in a transverse direction relative to the direction of the movement of said deck between said raised and lower positions for aligning the batched material supported by said deck with said entrance of said transfer enclosure when said deck is at said raised unloading position of said lift mechanism;

(e) said delivery conveyor including (i) an end portion disposed adjacent to said lowered loading position of said deck of said lift mechanism, and (ii) a main portion extending away from said lift mechanism to provide space for loading the batched material on said delivery conveyor, said delivery conveyor being operable to deposit the batched material at the location of said movable means on said deck of said lift mechanism each time said deck is disposed at said lowered loading position.

2. The apparatus of claim 1 wherein said movable means on said transfer deck is a rotatable conveyor.

3. The apparatus of claim 1, wherein said deck at said lowered loading position is located at an elevation lower than that of the inlet opening of the material processing apparatus, whereas said deck at said raised unloading position is located at an elevation higher than that of said lowered loading position and than that of the inlet opening of the material processing apparatus.

4. The apparatus of claim 1, wherein said transfer enclosure has a hood and a door pivotally mounted to said hood, said hood defining an interior chamber having said entrance on a side thereof and said exit spaced from said entrance on a bottom thereof.

5. The apparatus of claim 4, wherein said door is pivotally mounted at an upper end to said hood to undergo swinging movement relative to said hood between a lowered position in which said door closes said side entrance and a raised position in which said door opens said side entrance of said hood.

6. The apparatus of claim 1, further comprising:

a closure mechanism disposed contiguous with said exit of said transfer enclosure and being operable to control transfer of the batched material from said transfer enclosure through the inlet opening and into the material processing apparatus.

7. The apparatus of claim 5, wherein said closure mechanism includes a guide track, a closure gate and an actuator, said guide track having one end contiguous with said exit of said transfer enclosure and a remainder of said guide track extending away from said transfer enclosure, said closure gate being mounted to said guide track to undergo slidable movement therealong, said actuator being operable to reciprocally move said closure gate along said guide track relative to said transfer enclosure between an extended position and a retracted position in which said closure gate respectively closes and opens said exit of said transfer enclosure and the inlet opening of the material processing apparatus.

8. An apparatus for infeeding batched material to an inlet opening of a material processing apparatus, said batched material infeeding apparatus comprising:

(a) a lift mechanism disposed alongside a material processing apparatus and being operable to lift a batched material from a lowered loading position to a raised unloading position located at least at the elevation of an inlet opening of the material processing apparatus;

(b) a transfer enclosure spaced from said lift mechanism and disposed above the inlet opening of the material processing apparatus, said transfer enclosure having an entrance for receiving batched material from said lift mechanism and an exit for subsequent discharge of the batched material from said transfer enclosure into the material processing apparatus through the inlet opening thereof, said transfer enclosure having a hood and a door pivotally mounted to said hood, said hood defining an interior chamber having said entrance on a side thereof and said exit on a bottom thereof, said door being pivotally mounted at an upper end to said hood to undergo swinging movement relative to said hood between a lowered position in which said door closes said side entrance and a raised outward position relative to said hood in which said door opens said side entrance of said hood; and (c) a tilt assembly disposed between said transfer enclosure and said raised unloading portion of said lift mechanism and being operable to block a path for transfer of the batched material from said lift mechanism to said transfer enclosure in response to movement of said door from said raised position to said lowered position and to complete said transfer path in response to movement of said door from said lowered position to said raised position.

9. The apparatus of claim 8, further comprising:

a transfer mechanism spaced above said tilt assembly and extending between said transfer enclosure and said raised unloading position of said lift mechanism and being operable to transfer the batched material from said lift mechanism, over said tilt assembly, and into said transfer enclosure.

10. The apparatus of claim 9, wherein said transfer mechanism includes an elongated guide member and an elongated drive member spaced laterally from one another and extending between said entrance of said transfer enclosure and said raised unloading position of said lift mechanism.

11. The apparatus of claim 10, wherein said transfer mechanism also includes a pusher member extending transversely between and coupled at opposite ends to said elongated guide member and said elongated drive member, said elongated drive member being drivingly coupled to said pusher member so as to cause reciprocal movement of said pusher member between said raised unloading position of said lift mechanism and said entrance of said transfer enclosure to thereby transfer the batched material from said lift mechanism, across said tilt assembly, and into said transfer enclosure through said entrance thereof.

12. The apparatus of claim 8, wherein said lift mechanism includes a transfer deck for supporting the batched material and a drive assembly supporting said deck and being operable to move said deck between a lowered loading position and a raised unloading position.

13. The apparatus of claim 12, wherein said deck at said lowered loading position is located at an elevation lower than that of the inlet opening of the material processing apparatus, whereas said deck at said raised unloading position is located at an elevation higher than that of said lowered loading position and than that of the inlet opening of the material processing apparatus.

14. The apparatus of claim 8, further comprising:

a closure mechanism disposed contiguous with said exit of said transfer enclosure and being operable to control transfer of the batched material from said transfer enclosure through the inlet opening and into the material processing apparatus.

15. The apparatus of claim 14, wherein said closure mechanism includes a guide track, a closure gate and an actuator, said guide track having one end contiguous with said exit of said transfer enclosure and a remainder of said guide track extending away from said transfer enclosure, said closure gate being mounted to said guide track to undergo slidable movement therealong, said actuator being operable to reciprocally move said closure gate along said guide track relative to said transfer enclosure between an extended position and a retracted position in which said closure gate respectively closes and opens said exit of said transfer enclosure and the inlet opening of the material processing apparatus.

16. An apparatus for infeeding batched material to an inlet opening of a material processing apparatus, said batched material infeeding apparatus comprising:

(a) a lift mechanism disposed alongside a material processing apparatus and being operable to lift a batched material from a lowered loading position to a raised unloading position located at least at the elevation of an inlet opening of the material processing apparatus;

(b) a transfer enclosure spaced from said lift mechanism and disposed above the inlet opening of the material processing apparatus, said transfer enclosure having an entrance for receiving batched material from said lift mechanism and an exit for subsequent discharge of the batched material from said transfer enclosure into the material processing apparatus through the inlet opening thereof; and (c) a tilt assembly disposed between said transfer enclosure and said raised unloading portion of said lift mechanism and being operable to either block or complete a path for transfer of the batched material from said lift mechanism to said transfer enclosure, said tilt assembly having a platform extending between said raised unloading position of said lift mechanism and said entrance of said transfer enclosure, said platform being mounted to undergo pivotal movement about a transverse pivot axis between a first position and a second position more nearly horizontal than said first position, said platform in said first position obstructing said transfer path for the batched material from said lift mechanism to said transfer enclosure, whereas said platform in said second position completing said transfer path for the batched material from said lift mechanism to said transfer enclosure.

17. The apparatus of claim 16, wherein said transfer enclosure has a hood and a door pivotally mounted to said hood, said hood defining an interior chamber having said entrance on a side thereof and said exit spaced from said entrance on a bottom thereof.

18. The apparatus of claim 17, wherein said door is pivotally mounted at an upper end to said hood to undergo swinging movement relative to said hood between a lowered position in which said door closes said side entrance and a raised position in which said door opens said side entrance of said hood.

19. The apparatus of claim 17, wherein said door at said lowered position thereof overlies and engages an end portion of said platform and maintains said platform of said tilt assembly at said first position, obstructing said transfer path for the batched material from said lift mechanism to said hood, whereas said door at said raised position thereof permits said platform of said tilt assembly to move to said second position, completing said transfer path for the batched material from said lift mechanism to said hood.

20. An apparatus for infeeding batched material to an inlet opening of a material processing apparatus, said batched material infeeding apparatus comprising:

(a) a lift mechanism disposed alongside a material processing apparatus and being operable to lift a batched material in a first direction from a lowered loading position to a raised unloading position located at least at the elevation of an inlet opening of the material processing apparatus;

(b) a transfer enclosure spaced from said lift mechanism and disposed above the inlet opening of the material processing apparatus, said transfer enclosure having an entrance for receiving batched material from said lift mechanism and an exit for subsequent discharge of the batched material from said transfer enclosure into the material processing apparatus through the inlet opening thereof, said transfer enclosure having a door pivotally mounted to undergo swinging movement between a lowered position relative to said transfer enclosure in which said door closes said entrance and a raised outward position relative to said transfer enclosure in which said door opens said entrance;

(c) a transfer mechanism extending between said raised unloading position of said lift mechanism and said entrance to said transfer enclosure and being operable to transfer the batched material along a transfer path extending from said lift mechanism into said transfer enclosure in a second direction disposed in a transverse relation to the first direction; and (d) means disposed between said entrance of said transfer enclosure and said raised unloading portion of said lift mechanism for blocking said transfer path for the transfer of the batched material from said lift mechanism to said transfer enclosure in response to movement of said door from said raised position to said lowered position and for completing said transfer path in response to movement of said door from said lowered position to said raised position.

21. The apparatus of claim 20, wherein said lift mechanism includes a transfer deck for supporting the batched material and a drive assembly supporting said deck and being operable to move said deck between a lowered loading position and a raised unloading position.

22. The apparatus of claim 21, wherein said deck at said lowered loading position is located at an elevation lower than that of the inlet opening of the material processing apparatus, whereas said deck at said raised unloading position is located at an elevation higher than that of said lowered loading position and than that of the inlet opening of the material processing apparatus.

23. The apparatus of claim 20, wherein said transfer mechanism includes an elongated guide member and an elongated drive member spaced laterally from one another and extending between said entrance of said transfer enclosure and said raised unloading position of said lift mechanism.

24. The apparatus of claim 23, wherein said transfer mechanism also includes a pusher member extending transversely between and coupled at opposite ends to said elongated guide member and said elongated drive member, said elongated drive member being drivingly coupled to said pusher member so as to cause reciprocal movement of said pusher member between said raised unloading position of said lift mechanism and said entrance of said transfer enclosure to thereby transfer the batched material from said lift mechanism and into said transfer enclosure through said entrance thereof.

25. The apparatus of claim 20, wherein said transfer enclosure also has a hood, said door being pivotally mounted to said hood, said hood defining an interior chamber having said entrance on a side thereof and said exit spaced from said entrance on a bottom thereof.

26. The apparatus of claim 20, further comprising:

a closure mechanism disposed contiguous with said exit of said transfer enclosure and being operable to control transfer of the batched material from said transfer enclosure through the inlet opening and into the material processing apparatus.

27. The apparatus of claim 26, wherein said closure mechanism includes a guide track, a closure gate and an actuator, said guide track having one end contiguous with said exit of said transfer enclosure and a remainder of said guide track extending away from said transfer enclosure, said closure gate being mounted to said guide track to undergo slidable movement therealong, said actuator being operable to reciprocally move said closure gate along said guide track relative to said transfer enclosure between an extended position and a retracted position in which said closure gate respectively closes and opens said exit of said transfer enclosure and the inlet opening of the material processing apparatus.

28. An apparatus for infeeding batched material to an inlet opening of a material processing apparatus, said batched material infeeding apparatus comprising:

(a) a lift mechanism disposed alongside a material processing apparatus and being operable to lift a batched material in a first direction from a lowered loading position to a raised unloading position located at least at the elevation of an inlet opening of the material processing apparatus;

(b) a transfer enclosure spaced from said lift mechanism and disposed above the inlet opening of the material processing apparatus, said transfer enclosure having an entrance for receiving batched material from said lift mechanism and an exit for subsequent discharge of the batched material from said transfer enclosure into the material processing apparatus through the inlet opening thereof; and (c) a closure mechanism disposed contiguous with said exit of said transfer enclosure and being operable to control transfer of the batched material from said transfer enclosure through the inlet opening and into the material processing apparatus;

(d) said lift mechanism including (i) a transfer deck for supporting the batched material, and (ii) a drive assembly supporting said deck and being operable to move said deck between said lowered loading position and said raised unloading position, (iii) said transfer deck including movable means operable to undergo movement in a transverse direction relative to the direction of the movement of said deck between said raised and lower positions for aligning the batched material supported by said deck with said entrance of said transfer enclosure when said deck is at said raised unloading position of said lift mechanism.

29. The apparatus of claim 28, wherein said closure mechanism includes a guide track, a closure gate and an actuator, said guide track having one end contiguous with said exit of said transfer enclosure and a remainder of said guide track extending away from said transfer enclosure, said closure gate being mounted to said guide track to undergo slidable movement therealong, said actuator being operable to reciprocally move said closure gate along said guide track relative to said transfer enclosure between an extended position and a retracted position in which said closure gate respectively closes and opens said exit of said transfer enclosure and the inlet opening of the material processing apparatus.

30. The apparatus of claim 28, wherein said deck at said lowered loading position is located at an elevation lower than that of the inlet opening of the material processing apparatus, whereas said deck at said raised unloading position is located at an elevation higher than that of said lowered loading position and than that of the inlet opening of the material processing apparatus.

31. The apparatus of claim 28, wherein said transfer enclosure has a hood and a door pivotally mounted to said hood, said hood defining an interior chamber having said entrance on a side thereof and said exit spaced from said entrance on a bottom thereof.

32. The apparatus of claim 31, wherein said closure mechanism includes a guide track, a closure gate and an actuator, said guide track having one end contiguous with said bottom exit of said hood of said transfer enclosure and a remainder of said guide track extending away from said hood, said closure gate being mounted to said guide track to undergo slidable movement therealong, said actuator being operable to reciprocally move said closure gate along said guide track relative to said hood between an extended position and a retracted position in which said closure gate respectively closes and opens said bottom exit of said hood and the inlet opening of the material processing apparatus.

33. An apparatus for infeeding batched material to an inlet opening of a material processing apparatus, said batched material infeeding apparatus comprising:

(a) a lift mechanism disposed alongside a material processing apparatus and being operable to lift a batched material in a first direction from a lowered loading position to a raised unloading position located at least at the elevation of an inlet opening of the material processing apparatus;

(b) a transfer enclosure spaced from said lift mechanism and disposed above the inlet opening of the material processing apparatus, said transfer enclosure having an entrance for receiving batched material from said lift mechanism and an exit for subsequent discharge of the batched material from said transfer enclosure into the material processing apparatus through the inlet opening thereof, said transfer enclosure having a hood and a door pivotally mounted to said hood, said hood defining an interior chamber having said entrance on a side thereof and said exit spaced from said entrance on a bottom thereof;

(c) a closure mechanism disposed contiguous with said exit of said transfer enclosure and being operable to control transfer of the batched material from said transfer enclosure through the inlet opening and into the material processing apparatus, said closure mechanism including a guide track, a closure gate and an actuator, said guide track having one end contiguous with said bottom exit of said hood of said transfer enclosure and a remainder of said guide track extending away from said hood, said closure gate being mounted to said guide track to undergo slidable movement therealong, said actuator being operable to reciprocally move said closure gate along said guide track relative to said hood between an extended position and a retracted position in which said closure gate respectively closes and opens said bottom exit of said hood and the inlet opening of the material processing apparatus; and (d) a spacer attached to an end wall of said hood adjacent to said guide track and said closure gate and spaced above said bottom exit of said hood, said spacer being adapted to engage the batched material received in said hood upon said closure gate so as to prevent tilting of the batched material and thereby misalignment with the inlet opening of the material processing apparatus as said closure gate is moved from said extended to retracted position until said closure gate is substantially near said retracted position fully opening said bottom exit of said hood.

34. An apparatus for infeeding batched material to an inlet opening of a material processing apparatus, said batched material infeeding apparatus comprising:

(a) a transfer enclosure disposed above the inlet opening of the material processing apparatus, said transfer enclosure having an entrance for receiving batched material and an exit for subsequent discharge of the batched material from said transfer enclosure into the material processing apparatus through the inlet opening thereof, said transfer enclosure having a hood and a door pivotally mounted to said hood, said hood defining an interior chamber having said entrance on a side thereof and said exit spaced from said entrance on a bottom thereof;

(b) a closure mechanism disposed contiguous with said exit of said transfer enclosure and being operable to control transfer of the batched material from said transfer enclosure through the inlet opening and into the material processing apparatus, said closure mechanism including a guide track, a closure gate and an actuator, said guide track having one end contiguous with said bottom exit of said hood of said transfer enclosure and a remainder of said guide track extending away from said transfer enclosure, said closure gate being mounted to said guide track to undergo slidable movement therealong, said actuator being operable to reciprocally move said closure gate along said guide track relative to said transfer enclosure between an extended position and a retracted position in which said closure gate respectively closes and opens said bottom exit of said hood and the inlet opening of the material processing apparatus; and a spacer attached to an end wall of said hood adjacent to said guide track and said closure gate and spaced above said bottom exit of said hood, said spacer being adapted to engage the batched material received in said hood upon said closure gate so as to prevent tilting of the batched material and thereby misalignment with the inlet opening of the material processing apparatus as said closure gate is moved from said extended to retracted position until said closure gate is substantially near said retracted position fully opening said bottom exit of said hood.

35. The apparatus of claim 34, wherein said door is pivotally mounted at an upper end to said hood to undergo swinging movement relative to said hood between a lowered position in which said door closes said side entrance and a raised position in which said door opens said side entrance of said hood.

36. The apparatus of claim 35, further comprising:

means for preventing the release of any gases from the material processing apparatus to the external atmosphere during the transfer of batched material from the transfer enclosure and into said material processing apparatus.

37. An apparatus for infeeding batched material to an inlet opening of a material processing apparatus, said batched material infeeding apparatus comprising:

(a) a transfer enclosure disposed above the inlet opening of the material processing apparatus, said transfer enclosure having an entrance for receiving batched material and an exit for subsequent discharge of the batched material from said transfer enclosure into the material processing apparatus through the inlet opening thereof, said transfer enclosure including a hood defining an interior chamber and an inlet port separate from said entrance and an exhaust port separate from said exit in communication with said interior chamber;

(b) a closure mechanism disposed contiguous with said exit of said transfer enclosure and being operable to control transfer of the batched material from said transfer enclosure through the inlet opening and into the material processing apparatus; and (c) means for preventing the release of any gases from the material processing apparatus to the external atmosphere during the transfer of batched material from the transfer enclosure and into said material processing apparatus, said preventing means including means connected in communication with said exhaust port of said transfer enclosure hood and the material processing apparatus for exhausting gases from said exhaust port which entered said interior chamber from said exit of said transfer enclosure and for replacing said interior chamber with fresh air drawn in through said inlet port.

38. An apparatus for infeeding batched material to an inlet opening of a material processing apparatus, said batched material infeeding apparatus comprising:

(a) a transfer enclosure disposed above the inlet opening of the material processing apparatus, said transfer enclosure having an entrance for receiving batched material and an exit for subsequent discharge of the batched material from said transfer enclosure into the material processing apparatus through the inlet opening thereof, said transfer enclosure having a door pivotally mounted to undergo swinging movement between a lowered position relative to said transfer enclosure in which said door closes said entrance and a raised outward position relative to said transfer enclosure in which said door opens said entrance;

(b) a transfer mechanism adjacent to said entrance to said transfer enclosure and being operable to transfer the batched material along a transfer path and into said transfer enclosure;

(c) a closure mechanism disposed contiguous with said exit of said transfer enclosure and being operable to control transfer of the batched material from said transfer enclosure through the inlet opening and into the material processing apparatus; and (d) means disposed adjacent to said transfer mechanism and said entrance of said transfer enclosure for blocking said transfer path for the transfer of the batched material into said transfer enclosure in response to movement of said door from said raised position to said lowered position and for completing said transfer path in response to movement of said door from said lowered position to said raised position.

39. The apparatus of claim 38, wherein said transfer mechanism includes an elongated guide member and an elongated drive member, spaced laterally from one another, and a pusher member extending transversely between and coupled at opposite ends to said elongated guide member and said elongated drive member, said elongated drive member being drivingly coupled to said pusher member so as to cause reciprocal movement of said pusher member toward and away from said entrance of said transfer enclosure.

40. The apparatus of claim 39, wherein said transfer path blocking and completing means is a tilt assembly disposed below said pusher member and being operable to either block or complete said transfer path for transfer of the batched material into said transfer enclosure.

41. An apparatus for infeeding batched material to an inlet opening of a material processing apparatus, said batched material infeeding apparatus comprising:

(a) a transfer enclosure disposed above the inlet opening of the material processing apparatus, said transfer enclosure having an entrance for receiving batched material and an exit for subsequent discharge of the batched material from said transfer enclosure into the material processing apparatus through the inlet opening thereof;

(b) a transfer mechanism adjacent to said entrance to said transfer enclosure and being operable to transfer the batched material along a path and into said transfer enclosure, said transfer mechanism including an elongated guide member and an elongated drive member, spaced laterally from one another, and a pusher member extending transversely between and coupled at opposite ends to said elongated guide member and said elongated drive member, said elongated drive member being drivingly coupled to said pusher member so as to cause reciprocal movement of said pusher member toward and away from said entrance of said transfer enclosure;

(c) a closure mechanism disposed contiguous with said exit of said transfer enclosure and being operable to control transfer of the batched material from said transfer enclosure through the inlet opening and into the material processing apparatus; and (d) a tilt assembly disposed below said pusher member and being operable to either block or complete a transfer path for transfer of the batched material into said transfer enclosure, said tilt assembly having a platform adjacent to said entrance of said transfer enclosure, said platform being mounted to undergo pivotal movement about a transverse pivot axis between a first position and a second position more nearly horizontal than said first position, said platform in said first position obstructing said transfer path for the batched material to said transfer enclosure, whereas said platform in said second position completing said transfer path for the batched material to said transfer enclosure.

42. The apparatus of claim 41, wherein said transfer enclosure has a hood and a door pivotally mounted to said hood, said hood defining an interior chamber having said entrance on a side thereof and said exit spaced from said entrance on a bottom thereof.

43. The apparatus of claim 42, wherein said door is pivotally mounted at an upper end to said hood to undergo swinging movement relative to said hood between a lowered position in which said door closes said side entrance and a raised position in which said door opens said side entrance of said hood.

44. The apparatus of claim 43, wherein said door at said lowered position thereof overlies and engages an end portion of said platform and maintains said platform of said tilt assembly at said first position, obstructing said transfer path for the batched material to said hood, whereas said door at said raised position thereof permits said platform of said tilt assembly to move to said second position, completing said transfer path for the batched material to said hood.

* * * * *